United States Patent [19]

Mutrux

[11] 4,250,574

[45] Feb. 10, 1981

[54] ELECTRONIC TIMEPIECE IN WHICH AN INPUT TERMINAL OF THE INTEGRATED CIRCUIT IS USED AS AN OUTPUT TERMINAL

[75] Inventor: Claude Mutrux, Marin, Switzerland

[73] Assignee: Ebauches Electroniques SA, Marin, Switzerland

[21] Appl. No.: 958,435

[22] Filed: Nov. 7, 1978

[30] Foreign Application Priority Data

Nov. 11, 1977 [CH] Switzerland ..... 13785/77

[51] Int. Cl.[3] ..... G04B 17/12

[52] U.S. Cl. ..... 368/184; 368/185; 368/186; 368/187

[58] Field of Search ..... 58/23 R, 23 D, 85.5, 58/50 R; 368/184, 185, 186, 187

[56] References Cited

U.S. PATENT DOCUMENTS

| | | | |
|---|---|---|---|
| 3,998,044 | 12/1976 | Yamauchi et al. | 58/23 R |
| 4,081,951 | 4/1978 | Hersberger | 58/23 R |
| 4,133,169 | 1/1979 | Scherrer et al. | 58/23 R |
| 4,147,022 | 4/1979 | Ichikawa | 58/23 R X |

*Primary Examiner*—Ulysses Weldon

*Attorney, Agent, or Firm*—Wender, Murase & White

[57] ABSTRACT

The invention relates to an electronic timepiece in which an input terminal of the integrated circuit is used as an output terminal. During the manufacturing of the timepiece it is important to check the running of the frequency of the oscillator and the operation of at least part of the frequency divider chain. However, in a timepiece, the places available for obtaining measurements could be very limited, and the timepiece does not generally have an output terminal adapted to connect the signal to be measured to an external counter. The purpose of the invention is to utilize an already existing input terminal as an output terminal for permitting a precise and rapid checking of the frequency of the oscillator by measuring, on that terminal, a signal of intermediate frequency delivered by the frequency divider chain. A decoupling circuit permits the terminal to be utilized as an output terminal because it is arranged such that a logic signal delivered to its input is transmitted to its output to the exclusion of the signal of intermediate frequency.

8 Claims, 4 Drawing Figures

ELECTRONIC TIMEPIECE IN WHICH AN INPUT TERMINAL OF THE INTEGRATED CIRCUIT IS USED AS AN OUTPUT TERMINAL

BACKGROUND OF THE INVENTION

The present invention relates to an electronic timepiece comprising an integrated circuit with an oscillator, a frequency divider, a central circuit capable of controlling different functions of the timepiece, at least one input terminal a control logic of the display, a display unit, and control means.

In an electronic timepiece the control of the frequency of the oscillator may give rise to some problems. For example, a direct measurement of the frequency done via a sample of the signal at the quartz crystal level generally causes a small disturbance of the oscillator. On the other hand, the oscillator may be well adjusted, but the frequency divider chain may not function. It is for that reason that one generally prefers to control the running of the timepiece by sampling the signals at the end of the divider chain, before the display unit; e.g., at the output terminals which feed the motor in the case of a timepiece with a stepping motor. In a timepiece comprising a seconds hand it is quite common to find signals with a frequency of one Hertz, but not in timepiece comprising only hours and minutes hands where the period of the driving pulses may be extended, for example, to 5, 12, 20, 30 or 60 seconds. In this way, the power consumption is decreased which permits extension of the autonomy of the working of the timepiece while using batteries of small dimensions. But, when the repetition frequency of the driving signals is low, the measurement time becomes exceedingly long and the adjustment of the frequency of the oscillator, for example by way of a trimmer capacitor, becomes practically impossible.

To avoid the indicated drawbacks it is sufficient to take samples of the signals from the frequency divider chain which have an intermediate frequency such as 128 Hz. Such a signal allows a precise and rapid measurement of the frequency of the oscillator and a check of the working of the frequency divider.

However, in a watch, the number of places available for obtaining measurements is very limited, and the watch generally does not have a contact surface or output terminal adapted for connecting the signal to be measured to an external counter.

Swiss Pat. No. CH 593 513 discloses an electronic quartz crystal watch provided with a stepping motor and an electronic circuit having output terminals, normally used to deliver the driving pulses to the motor which are also used to measure the frequency of a signal delivered by the frequency divider chain. However, the solution disclosed by the Swiss patent is very specific to a timepiece provided with a stepping motor.

SUMMARY OF THE INVENTION

The purpose of the present invention is to permit precise and rapid control of the frequency of the oscillator by measuring a signal with an intermediate frequency delivered by the frequency divider chain on an already existing output terminal associated with one of the control means for effecting one of the functions of the timepiece.

To this end, the timepiece according to the present invention comprises an integrated circuit with an oscillator, a frequency divider, a control circuit capable of controlling different functions of the electronic timepiece, at least one input terminal, a control logic of the display, a display unit, and control means. The integrated circuit further comprises a decoupling circuit capable of delivering a signal from the integrated circuit at least indirectly to the input terminal which then takes over the function of an output terminal for measuring the signal, while at the same time, retaining its function as an input terminal to permit the control, via the control means and the decoupling circuit, of at least one of the functions of the timepiece.

The present invention will be described further, by way of example, with reference to the accompanying drawings.

DESCRIPTION OF THE PREFERRED EMBODIMENT

Figure 1:
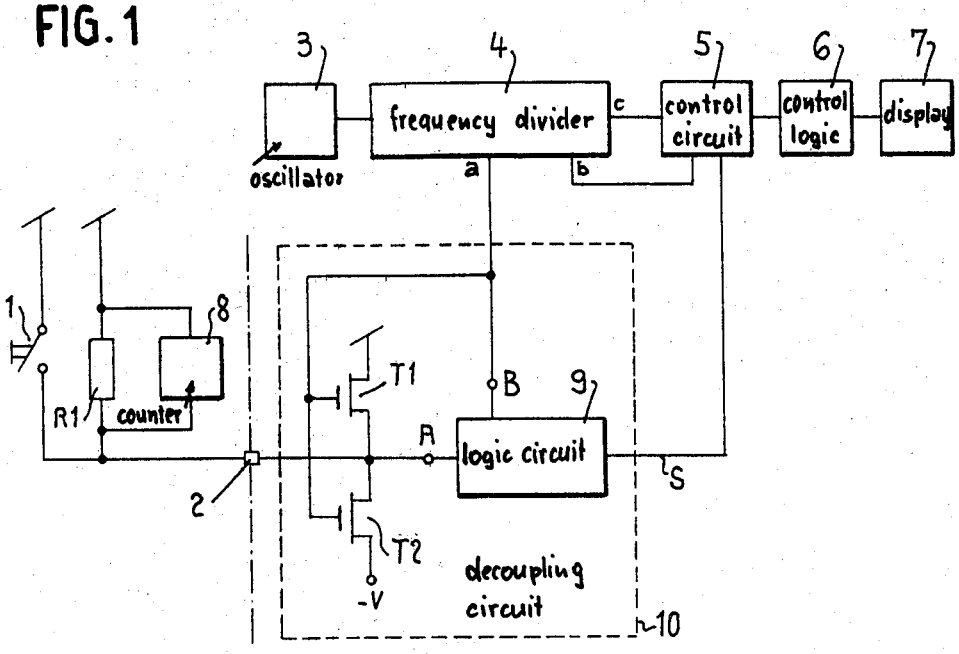
FIG. 1 is a block diagram of a first embodiment of an electronic timepiece in accordance with the present invention.

FIG. 1 is a block diagram of a first embodiment of the invention. The integrated circuit of the timepiece comprises an oscillator 3, a frequency divider chain 4, a circuit 5 for the control of at least one of the functions of the timepiece, a logic 6 for the control of the display unit 7, and a decoupling circuit 10 having an inverter comprising two transistors T1 and T2, and a logic circuit 9 which will be described later on. The integrated circuit comprises an input terminal 2 on which a contact 1 of one of the push-buttons of the timepiece may operate. The terminal 2 is connected to the output of the inverter T1, T2, which is connected to the output a of the frequency divider 4. The output a of the frequency divider 4 is also connected to the input B of the logic circuit 9, the output S of which is connected to one input of the control circuit 5. The control circuit 5 also receives signals from the outputs b and c of the frequency divider 4. A resistor R1 having a value of at least 400 kilohm is connected between the terminal 2 and the ground, outside of the timepiece. A measurement counter 8, intended to control the frequency of the oscillator, is connected in parallel with the resistor R1, outside of the timepiece.

In operation of the first embodiment, a signal of intermediate frequency, such as 128 Hz, is provided by the divider 4 on its output a which is directly connected to the input B of the circuit 9. The same signal, but 180 degrees out of phase, is from the inverter T1, T2 to the input A of the circuit 9, and to the input terminal 2, provided contact 1 is open. In that case, the signal of 128 Hz which is present on the terminal 2 may be measured by the external counter 8 which thus controls the frequency of the oscillator and the working of at least part of the frequency divider chain. It is to be seen that the terminal 2 behaves like an output terminal for the signal of intermediate frequency. The decoupling circuit 10 is arranged, as will be seen later, in a manner such that its output S, which controls the control circuit 5, is permanently in the logic state O while the contact 1 is open. The control circuit 5 as shown in FIG. 1, may be, for example, a simple electronic switch. When in this state, logic control circuit 5 has as its output a signal of low frequency, such as 1 Hz, or one twentieth Hz delivered by the output c of the divider 4. This signal controls the normal operation of the display unit. It is to be seen that the signal of 128 Hz does not appear at the output S of the decoupling circuit 10.

Let us examine now what happens when the contact 1 is closed. Upon closing the terminal 2 and the input terminal A of the logic circuit 9 are grounded, to produce a signal corresponding to the logic state L. The logic circuit 9 is arranged so that its output S then passes to the logic state L and remains in this state. The signal of intermediate frequency 128 Hz which is still present at input B does not appear at output S. The logic state L present at S controls the control circuit 5, so that its output corresponds to the output signal b of the divider 4. The signal b has a higher frequency (e.g. 32 Hz) than that of the signal c, and may be utilized, for example, to initiate a time setting operation. It is clear that when contact 1 is closed, the terminal 2 behaves like an input terminal and permits the control of one of the functions of the timepiece, e.g., a time setting operation. When the contact 1 is closed, the transistor T1 of the inverter is short-circuited while the transistor T2 of the same inverter continues to operate normally, short-circuiting the pole of the supply with which it is connected to ground in its conducting state. To avoid an exceedingly strong power consumption, the transistor T2 is integrated in such a manner such that its impedance during the conducting state is at least 50 kilohm. On the other hand, in order to reduce the energy consumption to a minimum, the pulse duration of the signal of intermediate frequency is made very short, e.g., 30 microseconds. These pulses are delivered by a pulse former not shown but incorporated in the divider 4.

Figure 2:
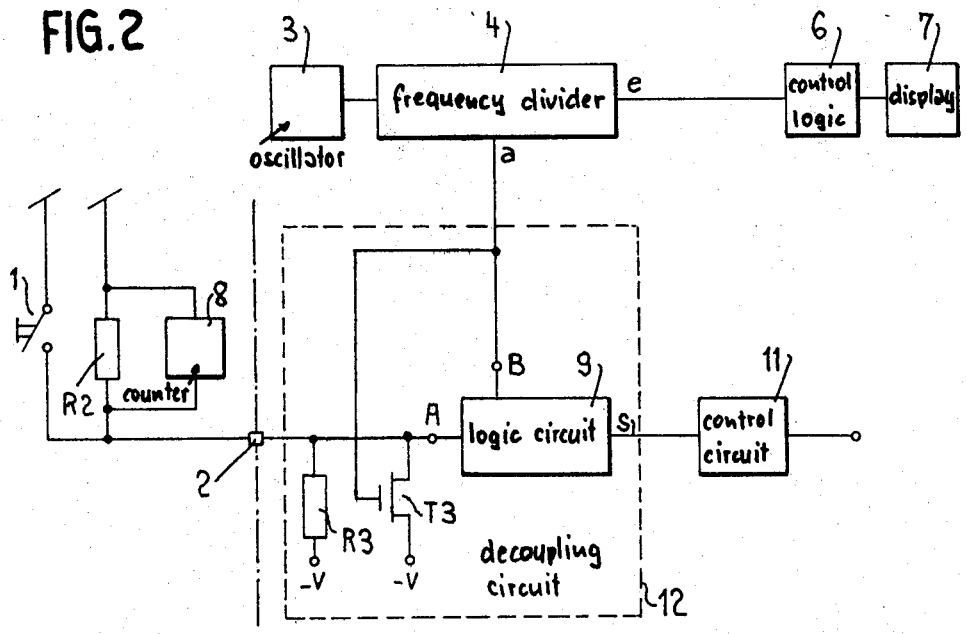
FIG. 2 is a block diagram of a second embodiment of an electronic timepiece in accordance with the present invention.

FIG. 2 is a block diagram of a second embodiment of the invention. The parts whose designation has not changed are identical to those of FIG. 1 and have the same function. It is to be seen that the inverter T1, T2 of FIG. 1 has been replaced by the combination of a resistor R3 in parallel with a transistor T3. The terminal 2 is connected to the output of transistor T3, and to the input A of the logic circuit 9. The input of transistor T3 is connected to the input B of circuit 9. The output S of circuit 9 is connected to the input of the circuit 11, which controls a determined, not stated, function of the timepiece.

In operation of the second embodiment, a signal of intermediate frequency, such as 128 Hz, is delivered by the output a of divider 4 to the input B of logic circuit 9, and to the input of transistor T3 which operates like an inverter. The resistor R3, which serves to determine the potential of terminal 2 when the resistor R2 and the counter 8 are not present and when the contact 1 is open, has a relatively high value, e.g., 1 megohom, whereas the impedance of transistor T3 in its conducting state is in the order of magnitude of 5 kilohm. The resistor R3 may also be replaced by a MOS transistor having the same impedance as R3, and further being permanently conducting. It should be noted that the input impedance of the circuit as measured on the terminal 2 varies with the control frequency between 1 kilohm and 5 kilohm. The resistor R2 should have an intermediate value, e.g., 100 kilohm, so that the signal of intermediate frequency, 128 Hz, is readily found on the terminals 2 and A, this signal being 180 degrees out of phase in comparison with the signal at B. As in the preceding case, the output S of the logic circuit 9 goes to the logic state 0 and remains in this state as long as contact 1 is open. The terminal 2 is therefore an output terminal for the output signal of 128 Hz, and it permits the checking of this frequency by the measurement counter 8. The signal of 128 Hz does not appear at the output S of the decoupling circuit 12.

If contact 1 is closed, the terminals 2 and A are grounded, and are consequently in the logic state L. The output S of circuit 12 goes from the logic state 0 to the logic state L and remains in this state as long as contact 1 is closed. In that case, terminal 2 behaves like an input terminal permitting, through contact 1 and control circuit 11, the input of a signal for effecting control of one of the functions of the timepiece. To reduce the power consumption to a minimum, transistor T3 is controlled by pulses having a very short duration, e.g., 30 microseconds, so that these pulses have a low pulse cyclic ratio. They are supplied, for example, by a pulse former not represented but incorporated in the divider 4, which is connected to the output a of the latter.

Among the possible different functions which can be incorporated in a timepiece and controlled using signals received on the input terminal 2 are functions such as: the stopping or correction by a frequency higher than normal, the checking of the state of charge of the battery, the correction of the running of the oscillator, the positioning of the timepiece in a state "play," or effecting illumination of the display (e.g., for LED display units).

On the other hand, it is obvious that the output signals produced on the same terminal 2 can have a frequency different from 128 Hz, and may be of any possible pulse cyclic ratio. Also, the output signal on the terminal 2 can have a signification different from that of a frequency. For example, a pulse train formed of three pulses which appears regularly after each pulse of 1 Hz driving the display may indicate an automatic correction of three tenths of a second per day of the running of the timepiece.

Figure 3:
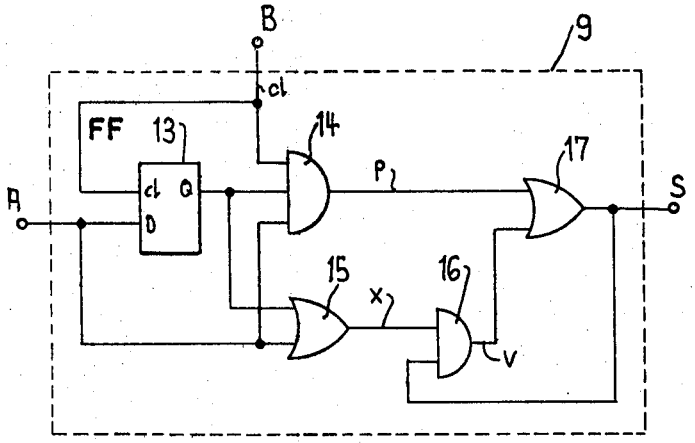
FIG. 3 is a schematic diagram of a circuit included in the block diagram of FIGS. 1 and 2.

FIG. 3 is a schematic diagram of a possible embodiment of the logic circuit 9. The input A is connected to the D input of a D type flip-flop FF13, to a first input of an OR gate 15, and to a first input of an AND gate 14. The input B is connected to the clock input of FF13, and to a second input of gate 14. The output Q of FF13 is connected to a third input of gate 14, and to a second input of gate 15. The output x of OR gate 15 is connected to a first input of an AND gate 16, whose output v is connected to a first input of an OR gate 17. The output P of gate 14 is connected to a second input of gate 17, whose output S is connected to the second input of gate 16.

Figure 4:
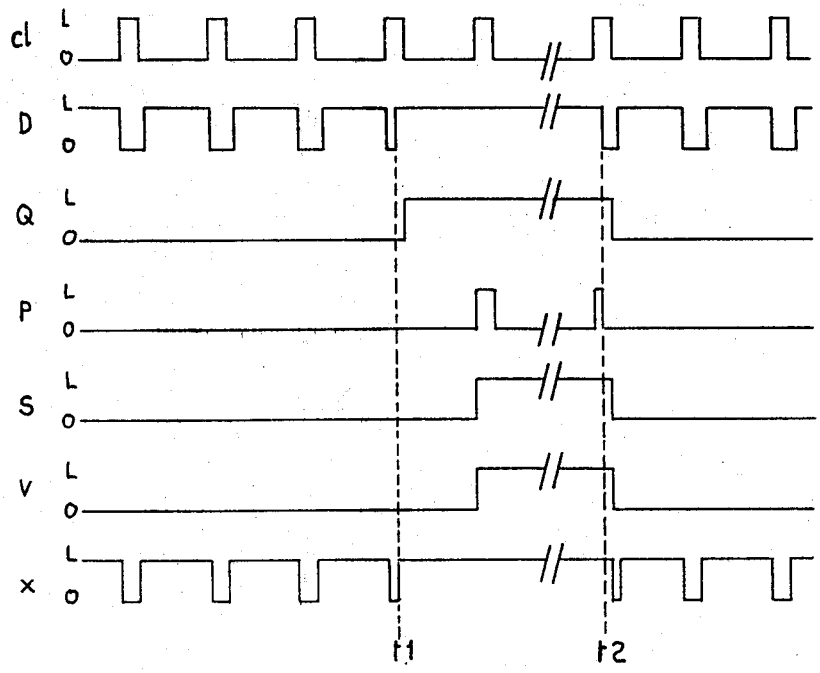
FIG. 4 is a pulse diagram associated with the circuit diagram of FIG. 3.

The operation of the circuit of FIG. 3 is explained hereunder with reference to the pulse diagram of FIG. 4. The signal of intermediate frequency (e.g. 128 Hz) is supplied at input B by the output a of the divider 4 shown in FIGS. 1 and 2. The same signal, 180 degrees out of phase, appears at input A via the inverters T1, T2 or T3 of FIGS. 1 and 2 respectively. This signal at A exists only when the contact 1 of FIGS. 1 and 2 is open. In that case, the change in state of FF13 is initiated only by the trailing edge of the clock signal, so the output Q permanently remains in the state 0, since D is at 0 before the appearance of the trailing edge of the clock signal.

Therefore, the output x of OR gate 15 is the same as that on the input A. The output S is at 0 and remains in that state because of its connection with the second input of gate 16. As indicated previously, the signal of intermediate frequency does not appear at output S of the circuit 9 when contact 1 is open, because the logic state of the output S remains at 0.

Let us suppose now that the contact 1 is closed at time t1. At this time, the input A and the D input of FF13 change from state 0 to state L. When the trailing edge of the next clock pulse arrives, FF13 changes state and its output Q goes to state L. One clock pulse later, the three inputs of AND gate 14 are in state L, so that the output P of this gate also goes to state L, where it remains for the whole duration of the clock pulse. The output x of gate 15 has also changed to state L at the same time as the input A. Due to these conditions, the output S changes to state L and remains in this state because of its connection with the second input of gate 16. Thus, when contact 1 is closed, the output S is in state L and, as in the preceding case, the signal of intermediate frequency is not present at this output.

Let us consider now the case where, during its closing operation, the contact 1 is affected with bounce. The diagram of FIG. 4 indicates immediately that any undesired opening of contact 1 which forces the D input of FF13 to momentarily change to state 0, and which arrives between two clock pulses or during such a clock pulse, has no effect on the output S of the circuit because FF13 does not change state. If, due to the bounce, the D input is at 0 at the moment when the trailing edge of the clock pulse appears, FF13 does not change and it is only when the trailing edge of the next clock pulse appears that FF13 changes state, provided contact 1 is still closed. The bounce appears during a time shorter than the period of the clock signal, it has no effect on the output S of the circuit, other than a delay of at least one period of the clock signal. This indicates that circuit 9 has an anti-bounce function. Finally, let us examine what happens at time t2 when the contact 1 is again opened. In that case, the D input of FF13 changes from state L to state 0, and the arrival of the trailing edge of the next clock pulse makes the Q output of FF13 change to state 0. Consequently, the output P of gate 14 also passes to state 0. The trailing edge of the signal at A is somewhat delayed in comparison to that of the clock pulse because of its longer path through the inverter; thus, there exists a short time interval during which the terminals D and Q are simultaneously at state 0. The duration of delay due to the signal travelling through the inverter T1, T2 is made longer than the propagation time between D and Q of FF13. Due to these conditions, the output S of the circuit changes from state L to state 0 remains in state 0 as previously explained.

It is to be seen that circuit 9 provides at its output the logic states present on terminal A as determined by the two possible states of contact 1, and further that the signal of intermediate frequency which is present on terminal A when the contact 1 is open never appears at the output terminal S. Furthermore, the circuit has an anti-bounce function.

Either decoupling circuit 10 or 12 thus permits utilization of an input terminal 2, which is normally provided for receiving input signals for effecting the control of different functions of the timepiece, as an output terminal for producing output signals allowing the measurement of different signals of the integrated circuit of the timepiece, including to measurement of the frequency of the oscillator.

The circuits which have been described above some of the possible embodiments of the present invention, but it is clear that the invention may encompass other circuits operating on the same principle.

What we claim is:

1. An electronic timepiece capable of performing different functions and having a means for supplying electrical power, an integrated circuit including an oscillator connected to a frequency divider for supplying various output signals for controlling a display means, comprising:

a control circuit for controlling the different functions of the timepiece in response to a logic signal;

said integrated circuit having at least one terminal for receiving a control input signal;

control means connected to said integrated circuit terminal for generating said control input signal; and a decoupling circuit connected to said integrated circuit terminal, said control circuit, and said frequency divider, said decoupling circuit being responsive to said control input signal for delivering at an output said logic signal to said control circuit;

said decoupling circuit further including means for receiving a measurement output signal produced by said frequency divider for measurement purposes and delivering said measurement output signal to said integrated circuit terminal, said receiving and delivering means precluding said measurement output signal from appearing at said logic signal output of said decoupling circuit, whereby said integrated circuit terminal may be used to control a timepiece function and also may be used for measurement of timepiece signals without interfering with timepiece operation.

2. A timepiece according to claim 1, wherein said decoupling circuit comprises:

a logic circuit having first and second input terminals, and further having a logic circuit output terminal connected to said logic signal output of said decoupling circuit; and an inverter responsive to said measurement output signal, said inverter having an inverter output connected both to said integrated circuit terminal and to said first logic circuit input terminal;

said logic circuit receiving said measurement output signal from said frequency divider at said second logic circuit input terminal and further being arranged such that said control input signal fed to said first logic circuit input terminal is transmitted to said logic circuit output terminal to the exclusion of said measurement output signal.

3. A timepiece according to claim 2, wherein said logic circuit includes means for selectively responding to said control input signal only during certain conditions resulting in an anti-bounce function.

4. A timepiece according to claim 2, wherein said logic circuit comprises a flip-flop having a positioning input which is connected to said first logic circuit input terminal, to a first input of a first AND gate, and to a first input of a first OR gate, the clock input of said flip-flop being connected to a second input of said first AND gate and to said second logic circuit input terminal receiving said measurement signal, the output of said flip-flop being connected to a third input of the first AND gate and to a second input of the first OR gate, the output of said first or gate being connected to a first input of a second AND gate, the output of said second AND gate being connected to a first input of a second OR gate, the second input of said second OR gate being connected to the output of said first AND gate, and the output of said second OR gate being connected to a second input of the second AND gate and also to said logic signal output terminal of said logic circuit.

5. A timepiece according to claim 1, wherein said decoupling circuit comprises:

a transistor receiving said measurement output signal from said frequency divider, said transistor being connected between said integrated circuit terminal and one of the poles of said power supply means;

a resistor connected between said integrated circuit terminal and said one pole of said power supplying means; and a logic circuit having a logic input terminal connected to said integrated circuit terminal and further having a logic output terminal, said logic circuit including means for transmitting said control input signal received at said logic input terminal to said logic circuit output terminal, to the exclusion of said measurement output signal from said frequency divider.

6. A timepiece according to claim 5, wherein said resistor is a MOS transistor having an impedance.

7. A timepiece according to claim 1, wherein said measurement output signal is a signal of intermediate frequency utilized to check the adjustment of the frequency of the oscillator.

8. A timepiece according to claim 1, wherein said measurement output signal is a pulse train having a signification different from that of a frequency utilized for checking the frequency of the oscillator so as to permit measurement of different signals of the timepiece.

* * * * *